United States Patent [19]

Desair

[11] Patent Number: 5,020,204

[45] Date of Patent: Jun. 4, 1991

[54] TOOL FOR ALIGNING THE CONNECTING OF AN EXHAUST MANIFOLD TO AN ENGINE BLOCK

[76] Inventor: Eugene Desair, HC 01, Box 40, Damar, Kans. 67632

[21] Appl. No.: 442,300

[22] Filed: Nov. 28, 1989

[51] Int. Cl.[5] ..... B66F 3/08

[52] U.S. Cl. ..... 29/271; 254/100

[58] Field of Search ..... 254/100, 131, DIG. 1, 254/DIG. 4; 29/238, 239, 256, 266; 411/395, 384, 413; 72/705

[56] References Cited

U.S. PATENT DOCUMENTS

| | | | |
|---|---|---|---|
| 806,088 | 11/1905 | Wands | 254/100 |
| 1,540,873 | 6/1925 | Bergh | 254/100 |
| 1,631,889 | 6/1927 | Rappley | 29/239 |
| 1,723,970 | 8/1929 | Jauch | 254/100 |
| 1,799,941 | 4/1931 | Wulle | 411/395 |
| 2,310,942 | 2/1943 | Donges | 254/100 |
| 3,325,095 | 6/1967 | Mueller et al. | 254/100 |
| 3,727,884 | 4/1973 | Custer | 254/100 |
| 3,869,934 | 3/1975 | Pierce | 254/100 |
| 4,925,364 | 5/1990 | Dos | 411/383 |

*Primary Examiner*—Robert C. Watson

*Attorney, Agent, or Firm*—John Wade Carpenter

[57] ABSTRACT

A tool having a pair of end members, each with an arcuate surface for engaging a riser section of an exhaust manifold. One of the end members is formed with a threaded cylindrical recess for threadably receiving an adjustment bolt having a cylindrical recess with smooth walls. The other end member is formed with a cylindrical peg or fitting which slidably passes into the smooth-walled cylindrical recess. A method for aligning apertures in an exhaust manifold with holes in cylinder heads of an engine block.

8 Claims, 2 Drawing Sheets

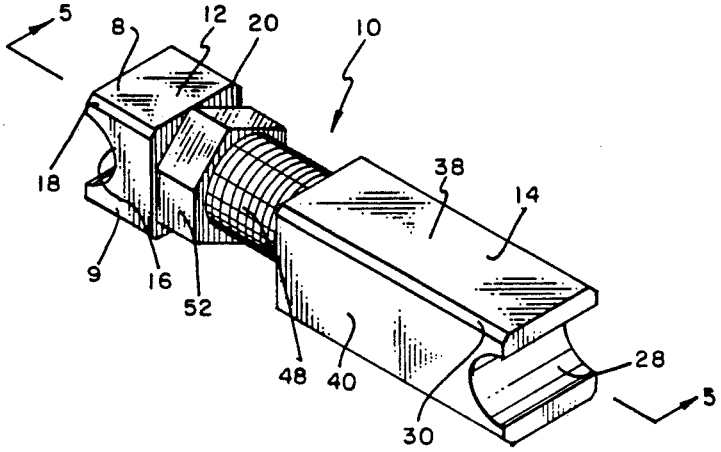
FIG. 1
FIG. 2
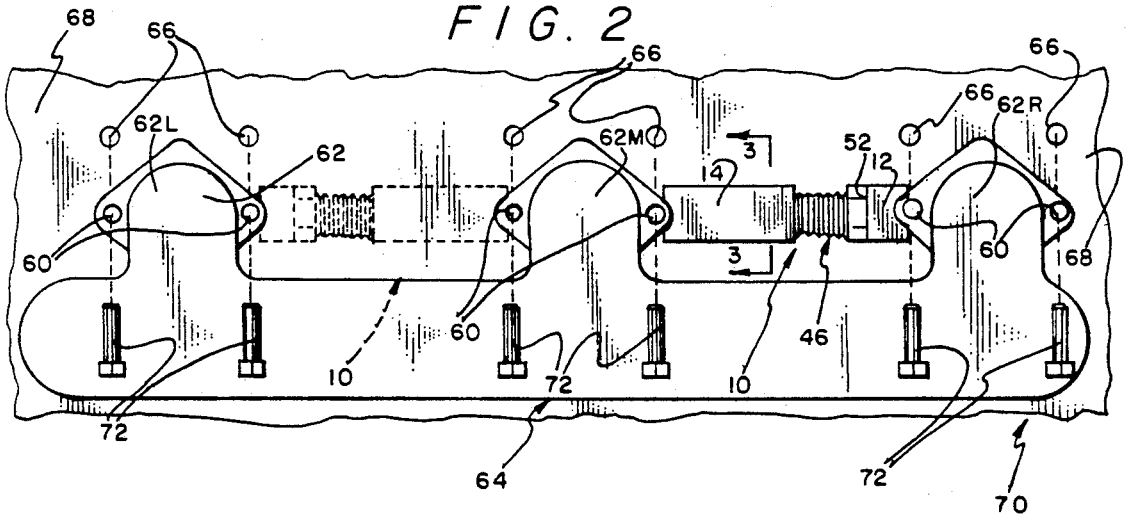
FIG. 3
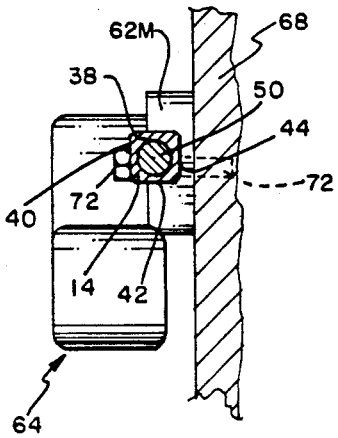
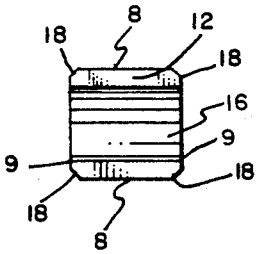
FIG. 4

TOOL FOR ALIGNING THE CONNECTING OF AN EXHAUST MANIFOLD TO AN ENGINE BLOCK

1. FIELD OF THE INVENTION

This invention is related to a tool. More particularly, this invention provides a tool and a method for aligning apertures in an exhaust manifold with holes in a cylinder block of an engine block.

2. DESCRIPTION OF THE PRIOR ART

A patentability investigation was conducted and the following U.S. Pat. Nos. were discovered: 3,540,698 to McFarland et al; 3,869,934 to Pierce; 3,727,884 to Custer; 3,920,219 to Hendrix Jr.; and 4,540,387 to Epino. None of these prior art patents specifically teach the particular tool and method of the present invention.

SUMMARY OF THE INVENTION

The present invention accomplishes its desired objects by broadly providing a tool for aligning apertures in an exhaust manifold with holes in cylinder heads of an engine block. The tool comprises a first member for contacting a first section of an exhaust manifold. The first member has a structure defining an elongated cylindrical fitting and an arcuate surface for contacting the first section of the exhaust manifold. A second member is provided for contacting a second section of the exhaust manifold. The secured member has a structure defining a threaded cylindrical bore and an arcuate surface for contacting the second section of the exhaust manifold. The tool further comprises an adjustment bolt means engaged to both the first member and to the second member for adjusting the distance between the first member and the second member. The adjustment bolt means has a structure defining a threaded cylindrical surface for threadably engaging the threaded cylindrical bore of the second member, a cylindrical recess for slidably receiving the elongated cylindrical fitting of the fist member, an a lug means for providing a surface that is to be contacted for rotating the adjustment bolt means. Preferably, the lug means is a nut integrally formed and bound to the structure of the adjustment bolt means, and the cylindrical recess extends through the nut. The threaded cylindrical bore terminates in a solid bottom; and the second member preferably has a structure further defining four generally planar surfaces with any two categories planar surfaces generally normal.

The present invention also accomplishes its desired objects by broadly providing a method for aligning apertures in an exhaust manifold with holes in cylinder heads of an engine block comprising the steps of:

(a) providing a tool comprising a first member having an arcuate surface for contacting a first section of an exhaust manifold and an elongated cylindrical fitting; a second member having an arcuate surface for contacting a second section of an exhaust manifold and a structure defining a threaded cylindrical bore; and an adjustment bolt means slidably engaged at one end thereof with said first member and threadably engaged at another and thereof with said second member such that when said adjustment bolt means is rotated in a predetermined direction, the distance between said first member and said second member changes;

(b) contacting a first section of an exhaust manifold with the arcuate surface of said first member; wherein said first section contains at least one first aperture;

(c) contacting a second section of the exhaust manifold with the arcuate surface of said second member, wherein said second section contains at least one second aperture; and (d) rotating the adjustment bolt means in a predetermined direction to cause the distance between the first section and the second section to change.

The method additionally comprises disposing prior to the contacting step (b) the first section and the second section against cylinder heads of an engine block wherein the cylinder heads contain at least one first cylinder hole and at least one second cylinder hole.

The method further comprises aligning prior to the contacting step (b) the first aperture of the first section with the first cylinder hole.

The method further comprises removing the tool from contacting the first section of the exhaust manifold and from contacting the second section of the exhaust manifold; and subsequently contacting the second section manifold and a third section of the exhaust manifold with the tool. The contacting of the second section of the exhaust manifold and the third section of the exhaust manifold with the tool comprises:

(i) contacting the second section of the exhaust manifold with the arcuate surface of the first member; and (ii) contacting the third section of the exhaust manifold with the arcuate surface of the second member, wherein the third section contains at least one third aperture.

Subsequently, the adjustment bolt means is rotated in a predetermined direction to cause the distance between the second section and the third section to change.

It is therefore an object of the present invention to provide a tool.

It is another object of the present invention to provide a method for aligning apertures in an exhaust manifold with holes in cylinder heads of an engine block.

These, together with the various ancillary objects and features which become apparent to those skilled in the art as the following description proceeds, are attained by this novel tool and process, a preferred embodiment being shown with reference to the accompanying drawings, by way of example only, wherein:

BRIEF DESCRIPTION OF THE DRAWINGS

FIG. 1 is a perspective view of the tool of this invention;

FIG. 2 is a front elevational view of a pair of tools engaged to the risers of an exhaust manifold;

FIG. 3 is a vertical sectional view taken in direction of the arrows and along the plane of line 3—3 in FIG. 2;

FIG. 4 is an end elevational view o the tool;

DETAILED DESCRIPTION OF THE INVENTION

Figure 5:
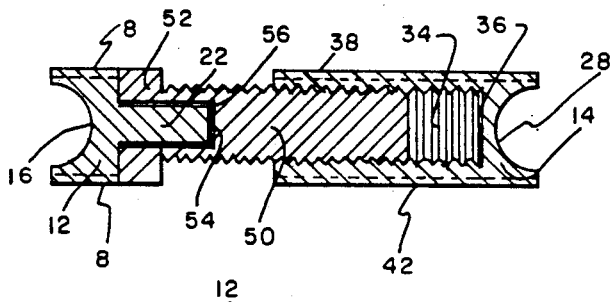
FIG. 5 is a vertical sectional view taken in direction of the arrows and along the plane of line 5—5 in FIG. 1.
Figure 6:
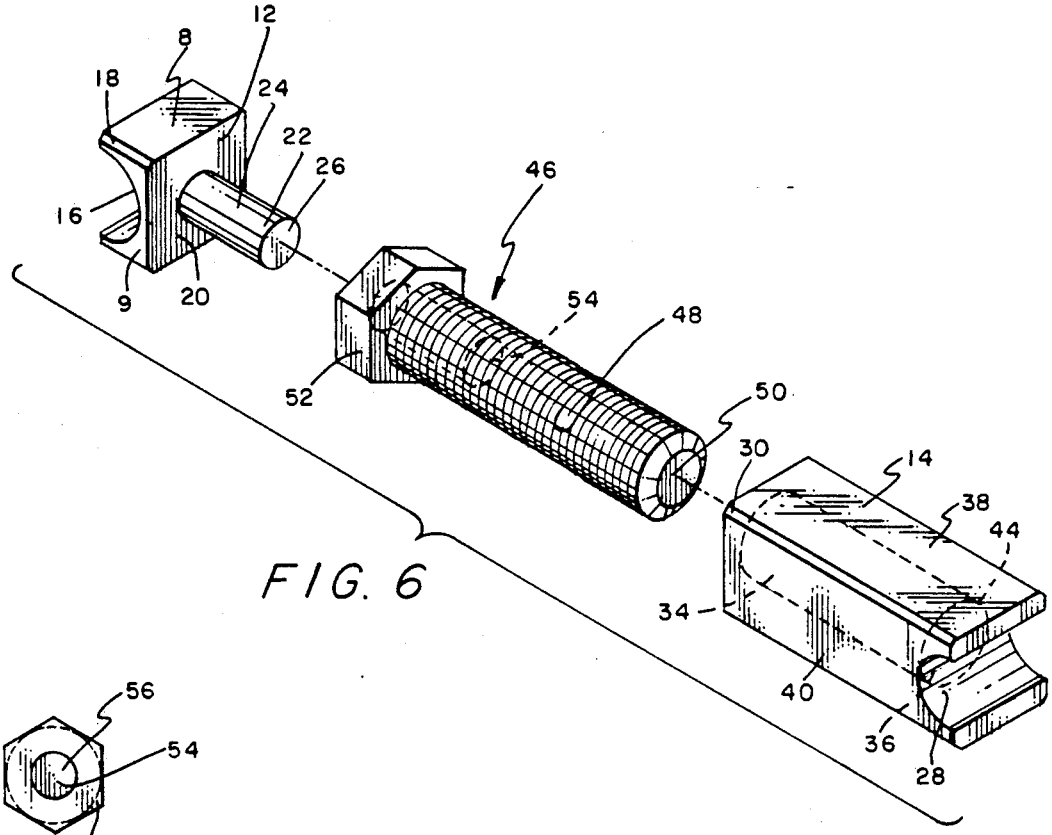
FIG. 6 is a segmented exploded perspective view of the tool.
Figure 7:
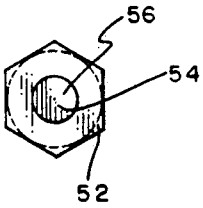
FIG. 7 is an end view of the adjustment bolt with the cylindrical recess therein.

Referring in detail now to the drawings wherein similar parts of the invention are identified by like reference numerals, there is seen a tool, generally illustrated as 10, having a pair of end members 12 and 14. End member 12 has a square-like geometric structure with an arcuate recess 16 and beveled corners 18. The arcuate recess 16 interrupts a pair of opposite sides 9—9 which are interconnected by sides 8—8 normal thereto end member 12 also has a bottom 20. A cylindrical peg or fitting 22 (or the like, such as a cylindrical tongue) having a smooth side 24 and a smooth bottom 26 is bound to the bottom 20 of the square-like geometric structure of the end member 12.

Figure 8:
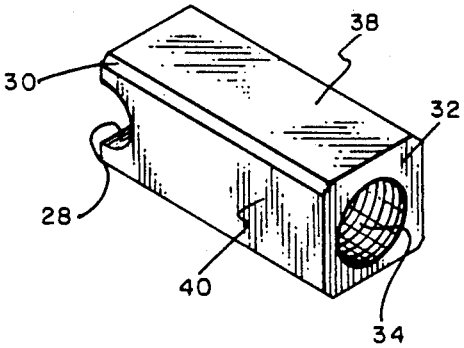
FIG. 8 is a perspective view of one of the end members having a threaded cylindrical recess for threadably receiving the adjustment bolt.

End member 14 has a rectangular-like geometric structure with an arcuate recess 28 and beveled corners 30. End member 14 has a bottom 32 which is interrupted by a threaded bore 34 having a solid bottom 36 terminating in and on the bottom 32 (as best shown in FIG. 8), more specifically terminating in a plane across the face of the bottom 32. End member 14 has sides 38, 40, 42 and 44.

The tool 10 also comprises an adjustment bolt, generally illustrated as 46, having a threaded cylindrical surface 48 on a cylindrical body 50, a lug or head 52 shaped as an hexagonal nut and formed integrally with the cylindrical body 50 at an end thereof. The lug or head 52 provides a surface that is to be contacted, such as with a wrench, for rotating the adjustment bolt 46 within the threaded bore 34. A clockwise rotation causes the adjustment bolt 46 to travel further into the bore 34 and towards the solid bottom 36 of the bore 34. Similarly, a counter-clockwise rotation causes the adjustment bolt 46 to travel out of the bore and away from the solid bottom 36. The adjustment bolt 46 is formed with a cylindrical recess or bore 54 that pierces and protrudes into the cylindrical body 50 and is generally coaxial therewith. The cylindrical bore 54 has a solid bottom 56 and a smooth internal wall, and terminates in and on the lug or head 52. More specifically, the bore 54 terminates in a plane across the face or top of the lug or head 52. The peg or fitting 22 slidably lodges in the bore 54 such that the bottom 20 of the end member 12 is flushed against the face or top of the lug or head 52 as best shown in FIG. 5. As is further best shown in FIG. 5, the length of the peg 22 is approximately the length of the depth of the bore 54.

When the tool 10 is assembled as depicted in FIG. 5, to shorten the distance between arcuate surfaces 16 of end member 12 and arcuate surface 28 of end member 14, a wrench or similar implement is secured around lug 52 and rotated clockwise to cause the adjustment bolt 50 to also rotate clockwise and travel towards the solid bottom 36 of the threaded bore 34, thus shortening the exposed length of the bolt 46 extending beyond the bottom 32 and increasing the length of the bolt 46 that extends into the bore 34 and threadably engaging the same. While the bolt 50 is being rotated clockwise, the face of the lug or head 52 rotates against the bottom 20 of the end member 12 and the peg or fitting 22 has the smooth walls of the cylindrical bore 54 being rotated around the outside thereof. As previously indicated, the peg or fitting 22 has a smooth side 24 to facilitate the turning of the bolt 46 about the peg or fitting 22 while the latter is slidably, rotatably disposed within the smooth-walled bore 54. Similarly, to lengthen the distance between the end members 12 and 14 and particularly the distance between arcuate surface 16 and arcuate surface 28, the lug 52 is rotated counter-clockwise, causing the adjustment bolt 50 to rotate counter clockwise and travel away from the solid bottom 36 of the threaded bore 34. Such rotational action causes the length of the bolt 46 extending beyond the bottom 32 to increase, and a decrease in the length of the bolt 46 that extends into the threaded bore 34. The tool 10 is particularly suited for aligning aperture 60 in hollow risers 62 of an exhaust manifold, generally illustrated as 64, with holes 66 in cylinder heads 68 of an engine block, generally illustrated as 70. When apertures 60 are registered or aligned with holes 66 the exhaust manifold 64 can be connected to the cylinder heads 68 of the engine block 70 by bolts 72. As best shown, in FIG. 2 the risers 62 are represented by three risers 62L, 62M and 62R.

With continuing reference to the drawings (particularly FIG. 2) for operation of the invention, the exhaust manifold 64 is disposed against the cylinder head 68 of the engine block 70 side that the risers 62L, 62M and 62R are flushed thereagainst and the inside of the hollow risers 62 communicate with the inside of the cylinder heads 68. Typically, holes 66 will not register or align with aperture 60 of all of the risers 62 for some reason (e.g. previous expansion of the metals due to heat, etc); thus the tool 10 of this invention is provided to insert between a pair of risers 62—62 such that when the adjustment bolt 46 is rotated with a wrench, the manifold 64, more specifically the risers 62 of the manifold 64, is stretched or moved apart. This is more particularly accomplished by firmly contacting the riser 62M with arcuate surface 28 of the end member 14 and firmly contacting the riser 62R with the arcuate surface 16 of the end member 12, all as best illustrated in FIG. 2. Typically before disposing the tool 10 as such, one of risers 62 is stationarily affixed to the cylinder head 62R by passing bolts 72—72 through its respective apertures 600-60 and into the holes 66—66 of the engine block 70 or cylinder head 68. To illustrate the present invention, it is assumed that riser 62R is initially secured to the block 20 or head 68. After the tool 10 is firmly placed as such, in order to move riser 62M away from riser 62R, lug 52 is engaged by a wrench and is subsequently rotated in a predetermined direction, such as counter-clockwise, to cause the distance between the end members 14 and 16 (more specifically the arcuate surfaces 16 and 28 at the end members 14 and 16) to change (more specifically to increase) and stretch or increase the distance between risers 62R and 62M to eventually, after sufficient rotations of the lug 52 of the adjustment bolt 46, to cause apertures 60—60 to align and registered with holes 66—66 such that the bolts 72—72 can readily pass through apertures 60—60 and holes 66—66 to secure riser 62M against the cylinder head 68 of the engine block 70. After the riser 62M has been secured as such, the tool 10 is removed from between risers 62R and 62M and the process is repeated by inverting the tool 10 between risers 62L and 62M (see dotted line representations of tool 10 in FIG. 2) to stretch the distance between risers 62L and 62M in order to align the apertures 60—60 of riser 62L with holes 66—66 for securing riser 62L to cylinder head 68 and engine block 70. It is readily apparent that distances between riser 62L and 62M can be decreased by initially securing risers 62L and 62R of the cylinder head 68 and inserting and operating tool 10 between risers 62M and 62R.

While the present invention has been described herein with reference to particular embodiments thereof, a latitude of modification, various changes and substitutions are intended in the foregoing disclosure, and it will be appreciated that; in some instances some features of the invention will be employed without a corresponding use of other features without departing from the scope of the invention as set forth.

I claim:

1. A tool for aligning apertures in an exhaust manifold with holes in cylinder heads of an engine block comprising a first member for contacting a first section of an exhaust manifold, said first member having a structure defining an elongated cylinder fitting and an arcuate surface for contacting said first section of said exhaust manifold; a second member for contacting a second section of said exhaust manifold, said second member having a structure defining a threaded cylindrical bore and an arcuate surface for contacting said second section of said exhaust manifold; and an adjustment bolt means engaged directly to both said first member and to said second member for adjusting the distance between said first member and said second member, said adjustment bolt means having a structure defining a threaded cylindrical surface for directly threadably engaging said threaded cylindrical bore of said second member, a cylindrical recess for directly slidably receiving said elongated cylindrical fitting of said first member, and a lug means for providing a surface that is to be contacted for rotating the adjustment bolt means.

2. The tool of claim 1 wherein said lug means is a nut integrally formed and bound to the structure of said adjustment bolt means, and said cylindrical recess extends through said nut.

3. The tool of claim 2 wherein said threaded cylindrical bore terminates in a solid bottom.

4. The tool of claim 3 wherein said second member has a structure further defining four generally planar surfaces with any two contiguous planar surfaces being generally normal.

5. A tool for aligning apertures in an exhaust manifold with holes in cylinder heads of an engine block comprising a first member for contacting a first section of an exhaust manifold, said first member having a structure defining an elongated cylinder fitting and an arcuate surface for contacting said first section of said exhaust manifold; a second member for contacting a second section of said exhaust manifold, said second member having a structure defining a threaded cylindrical bore and an arcuate surface for contacting said second section of said exhaust manifold; and an adjustment bolt means engaged to both said first member and to said second member for adjusting the distance between said first member and said second member, said adjustment bolt means having a structure defining a threaded cylindrical surface for threadably engaging said threaded cylindrical bore of said second member, a cylindrical recess for slidably receiving said elongated cylindrical fitting of said first member, and a lug means for providing a surface that is to be contacted for rotating the adjustment bolt means; said second member further defining four generally second planar surfaces with any two contiguous planar surfaces being generally normal and with said actuate surface of said second member terminating in two of said second planar surfaces that are opposed with respect to each other; and said first member further defining four generally first planar surfaces with any two continuous planar surfaces being generally normal and with said arcuate surface of said first member terminating in two of said first planar surfaces that are opposed with respect to each other.

6. The tool of claim 5 wherein said adjustment bolt means directly engages both said first member and said second member; said threaded cylindrical surface of said adjustment bolt means directly engages said threaded cylindrical bore of said second member and said cylindrical recess of said adjustment bolt means directly slidably receives said elongated cylindrical fitting of said first member.

7. The tool of claim 6 wherein said lug means is a nut integrally formed and bound to the structure of said adjustment bolt means, and said cylindrical recess extends through said nut.

8. The tool of claim 7 wherein said threaded cylindrical bore terminates in a solid bottom.

* * * * *